US012529530B2

(12) United States Patent
Joardar et al.

(10) Patent No.: US 12,529,530 B2
(45) Date of Patent: Jan. 20, 2026

(54) HIGH PERFORMANCE LANCED SINE WAVE FIN CONFIGURATION

(71) Applicant: Carrier Corporation, Palm Beach Gardens, FL (US)

(72) Inventors: Arindom Joardar, Jamesville, NY (US); Lokanath Mohanta, Liverpool, NY (US); Mustafa Koz, Brewerton, NY (US); Fatemeh Hejripour Rafsanjani, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 202 days.

(21) Appl. No.: 18/184,124

(22) Filed: Mar. 15, 2023

(65) Prior Publication Data

US 2023/0296329 A1 Sep. 21, 2023

Related U.S. Application Data

(60) Provisional application No. 63/319,980, filed on Mar. 15, 2022.

(51) Int. Cl.
*F28F 3/02* (2006.01)

(52) U.S. Cl.
CPC ..... *F28F 3/027* (2013.01); *F28F 2215/08* (2013.01)

(58) Field of Classification Search
CPC ..... F28F 3/027; F28F 2215/08
USPC ..... 165/151
See application file for complete search history.

(56) References Cited

U.S. PATENT DOCUMENTS 3,645,330 A * 2/1972 Albright ..... F28F 1/32 165/181
3,796,258 A * 3/1974 Malhotra ..... F28F 1/325 29/890.047
4,300,629 A * 11/1981 Hatada ..... F28F 1/325 165/151
4,365,667 A * 12/1982 Hatada ..... F28F 1/325 165/181
4,434,844 A * 3/1984 Sakitani ..... F28F 1/325 165/133
4,614,230 A * 9/1986 Sakuma ..... F28F 1/325 165/181
4,691,768 A * 9/1987 Obosu ..... F28F 1/325 165/151

(Continued)

FOREIGN PATENT DOCUMENTS

CN 110081764 B 9/2021
EP 325553 B1 5/1992

(Continued)

OTHER PUBLICATIONS

Extended European Search Report for European Application No. 23161925.5; Report Mail Date Jul. 18, 2023 (8 pages).

*Primary Examiner* — Claire E Rojohn, III
(74) *Attorney, Agent, or Firm* — CANTOR COLBURN LLP

(57) ABSTRACT

A heat exchanger includes a plurality of plate fins. At least one plate fin has a plurality of holes arranged in one or more rows and a contoured region formed adjacent one of the plurality of holes having a sinusoidal corrugation. The contoured region includes a plurality of elongate adjustable lance elements. The plurality of elongate adjustable lance elements are lowered relative to a central plane arranged at a midpoint of an amplitude of the sinusoidal corrugation.

8 Claims, 5 Drawing Sheets

(56) References Cited

U.S. PATENT DOCUMENTS 4,705,105 A * 11/1987 Cur ..... F28F 1/325 165/151
4,723,599 A * 2/1988 Hanson ..... F28F 1/325 165/181
4,817,709 A * 4/1989 Esformes ..... F28F 1/325 165/182
4,860,822 A * 8/1989 Sacks ..... F28F 1/325 165/181
4,909,319 A * 3/1990 Ishikawa ..... F28F 1/325 165/151
4,984,626 A * 1/1991 Esformes ..... F28F 1/325 165/181
5,042,576 A * 8/1991 Broadbent ..... F28F 1/325 165/181
5,056,594 A * 10/1991 Kraay ..... F28F 1/325 165/181
5,062,475 A * 11/1991 Bemisderfer ..... F28F 1/34 165/181
5,099,914 A * 3/1992 Reifel ..... F28F 1/325 165/151
5,111,876 A * 5/1992 Nash ..... F28F 17/005 165/181
5,168,923 A * 12/1992 Sacks ..... F28F 1/12 29/890.047
5,207,270 A * 5/1993 Yokoyama ..... F28F 1/325 165/182
5,353,866 A * 10/1994 Ueda ..... F28F 1/325 165/181
5,360,060 A * 11/1994 Tanaka ..... F28F 1/325 165/181
5,509,469 A * 4/1996 Obosu ..... F28F 1/325 165/182
5,553,663 A * 9/1996 Yu ..... F28F 1/325 165/151
5,660,230 A * 8/1997 Obosu ..... F28F 1/325 165/182
5,722,485 A * 3/1998 Love ..... F28F 1/325 165/151
5,738,168 A * 4/1998 Patel ..... F28F 1/325 165/181
5,752,567 A * 5/1998 Obosu ..... F28F 1/325 165/182
5,755,281 A * 5/1998 Kang ..... F28F 1/325 165/181
5,848,638 A * 12/1998 Kim ..... F28F 1/325 165/181
5,927,393 A * 7/1999 Richter ..... F28F 1/32 165/182
6,786,274 B2 * 9/2004 Bemisderfer ..... F28D 1/0477 165/181
6,976,529 B2 * 12/2005 Kester ..... F28F 1/325 62/515
7,082,989 B2 * 8/2006 Kobayashi ..... F28D 1/0477 165/181
7,124,813 B2 * 10/2006 Kester ..... F28F 1/325 29/890.047
7,219,716 B2 * 5/2007 Oh ..... F28F 1/32 165/182
7,261,147 B2 * 8/2007 Oh ..... F28F 1/32 165/151
7,360,585 B2 * 4/2008 Berggren ..... F28F 1/22 165/151
8,267,160 B2 * 9/2012 Hancock ..... F28F 1/325 165/182
8,505,618 B2 8/2013 Ogawa et al.
8,973,647 B2 * 3/2015 Seo ..... F24F 13/30 165/181
8,978,743 B2 * 3/2015 Tamura ..... F28D 1/0477 165/182
9,086,243 B2 * 7/2015 Komori ..... F28D 1/0477
9,353,997 B2 * 5/2016 Kim ..... F28F 17/005
9,441,890 B2 * 9/2016 Kim ..... F28F 1/28
9,528,779 B2 * 12/2016 Lee ..... F28F 13/00
9,605,908 B2 * 3/2017 Kim ..... F28F 1/325
9,644,896 B2 * 5/2017 Nagai ..... F28D 1/0477
D800,282 S * 10/2017 Hanson ..... D23/323
9,958,215 B2 * 5/2018 Buckrell ..... F28F 1/128
10,082,344 B2 * 9/2018 Tanda ..... F25B 39/02
10,209,012 B2 * 2/2019 Berthelot ..... F28F 1/32
10,415,894 B2 * 9/2019 Abrahamian ..... F28F 1/325
10,801,784 B2 * 10/2020 Nagano ..... F28F 1/32
10,921,065 B2 * 2/2021 Mahajan ..... F28F 9/013
11,162,741 B2 * 11/2021 Berthelot ..... F28F 1/20
2003/0000686 A1 * 1/2003 Kester ..... F28F 17/005 165/150
2003/0150601 A1 * 8/2003 Park ..... F28F 1/325 165/182
2005/0016240 A1 * 1/2005 Zurawel ..... F28F 3/027 72/177
2006/0005956 A1 1/2006 Kester
2008/0190588 A1 * 8/2008 Heidenreich ..... F28F 1/325 165/181
2012/0227945 A1 * 9/2012 Taras ..... F28F 17/005 165/172
2018/0306533 A1 * 10/2018 Alahyari ..... F28F 19/006
2020/0096206 A1 * 3/2020 Kim ..... F28F 1/14
2021/0148657 A1 * 5/2021 Joardar ..... F25B 39/00
2023/0296329 A1 * 9/2023 Joardar ..... F28F 3/027 165/151
2025/0155202 A1 * 5/2025 Joardar ..... F28F 1/325

FOREIGN PATENT DOCUMENTS

EP 789216 A2 8/1997
EP 2119995 B1 5/2018
EP 2767791 B1 5/2019
EP 2767790 B1 12/2019
WO 0175386 A1 10/2001
WO 2007004456 A1 1/2007
WO 2007147754 A1 12/2007
WO 2013157212 A1 10/2013

* cited by examiner

HIGH PERFORMANCE LANCED SINE WAVE FIN CONFIGURATION

CROSS-REFERENCE TO RELATED APPLICATIONS

This application claims the benefit of U.S. Application No. 63/319,980, filed Mar. 15, 2022, the contents of which are incorporated by reference herein in their entirety.

BACKGROUND

Embodiments of the present disclosure relate to the art of finned tube heat exchanger coils, and more particularly, to plate fins including a lanced sine-wave heat transfer surface for use in heating, ventilation, and air-conditioning and a method for manufacturing thereof.

Lanced fins have been used previously to provide a surface variation that enhances the transfer of heat energy between the fluids passing through the tubular members and over the plate fin surfaces. Although the existing lanced fin design, in which the lance elements are moved upwardly relative to the plate fin has been in use for years, no optimization of such a configuration has been performed due to the inherent complexities of the geometry of the lanced fin. In most applications, a single fin-die equipment is used to manufacture a family of heat exchangers with a range of fin densities. Although the fin surface design remains same, the spacing between the fin changes by varying the fin collar height. While the fin spacing is a variable parameter within certain limits, the lance-offset is a fixed design parameter for the given fin-die and is a function of the spacing between two adjacent fins.

BRIEF DESCRIPTION

According to an embodiment, a heat exchanger includes a plurality of plate fins. At least one plate fin has a plurality of holes arranged in one or more rows and a contoured region formed adjacent one of the plurality of holes having a sinusoidal corrugation. The contoured region includes a plurality of elongate adjustable lance elements. The plurality of elongate adjustable lance elements are lowered relative to a central plane arranged at a midpoint of an amplitude of the sinusoidal corrugation.

In addition to one or more of the features described herein, or as an alternative, in further embodiments the contoured region is arranged between adjacent holes within one of the one or more rows.

In addition to one or more of the features described herein, or as an alternative, in further embodiments the sinusoidal corrugation extends over at least one sinusoidal corrugation wavelength.

In addition to one or more of the features described herein, or as an alternative, in further embodiments the at least one sinusoidal corrugation wavelength includes two sinusoidal corrugation wavelengths, and the two sinusoidal corrugation wavelengths are constant.

In addition to one or more of the features described herein, or as an alternative, in further embodiments the at least one sinusoidal corrugation wavelength includes two sinusoidal corrugation wavelengths, and the two sinusoidal corrugation wavelengths vary.

In addition to one or more of the features described herein, or as an alternative, in further embodiments each of the plurality of elongate adjustable lance elements has a cross-section that is a segment of the sinusoidal corrugation.

In addition to one or more of the features described herein, or as an alternative, in further embodiments the sinusoidal corrugation includes at least one peak and at least one valley. At least one elongate adjustable lance element of the plurality of elongate adjustable lance elements is formed at the at least one valley.

In addition to one or more of the features described herein, or as an alternative, in further embodiments the at least one elongate adjustable lance element of the plurality of elongate adjustable lance elements formed at the at least one valley has a generally convex curvature.

In addition to one or more of the features described herein, or as an alternative, in further embodiments the sinusoidal corrugation includes at least one peak and at least one valley. At least one elongate adjustable lance element of the plurality of elongate lance elements is formed at the at least one peak.

In addition to one or more of the features described herein, or as an alternative, in further embodiments the at least one elongate lance element of the plurality of elongate lance elements formed at the at least one peak has a generally concave curvature.

According to an embodiment, a heat exchanger includes a plurality of plate fins. At least one plate fin has a plurality of holes arranged in one or more rows and a contoured region formed adjacent one of the plurality of holes having a sinusoidal corrugation. The contoured region includes a plurality of elongate adjustable lance elements. Each of said plurality of elongate adjustable lance elements are spaced a further distance from a central plane arranged at a midpoint of an amplitude of the sinusoidal corrugation than the sinusoidal corrugation.

In addition to one or more of the features described herein, or as an alternative, in further embodiments the contoured region is arranged between adjacent holes within one of the one or more rows.

In addition to one or more of the features described herein, or as an alternative, in further embodiments the sinusoidal corrugation extends over at least one sinusoidal corrugation wavelength.

In addition to one or more of the features described herein, or as an alternative, in further embodiments the at least one sinusoidal corrugation wavelength includes two sinusoidal corrugation wavelengths, and the two sinusoidal corrugation wavelengths are constant.

In addition to one or more of the features described herein, or as an alternative, in further embodiments the at least one sinusoidal corrugation wavelength includes two sinusoidal corrugation wavelengths, and the two sinusoidal Corrugation wavelengths vary.

In addition to one or more of the features described herein, or as an alternative, in further embodiments each of the plurality of elongate adjustable lance elements has a cross-section that is a segment of the sinusoidal corrugation.

In addition to one or more of the features described herein, or as an alternative, in further embodiments the sinusoidal corrugation includes at least one peak and at least one valley. At least one elongate adjustable lance element of the plurality of elongate adjustable lance elements is formed at the at least one valley.

In addition to one or more of the features described herein, or as an alternative, in further embodiments the at least one elongate lance element of the plurality of elongate adjustable lance elements formed at the at least one valley has a generally convex curvature.

In addition to one or more of the features described herein, or as an alternative, in further embodiments the sinusoidal corrugation includes at least one peak and at least one valley. At least one elongate adjustable lance element of the plurality of elongate lance elements is formed at the at least one peak.

In addition to one or more of the features described herein, or as an alternative, in further embodiments the at least one elongate lance element of the plurality of elongate adjustable lance elements formed at the at least one peak has a generally concave curvature.

The present invention involves an interrupted plate fin heat exchanger configuration with a plurality of lances displaced from the crests and troughs of the wavy fin connecting adjacent tube collars. This unique lance configuration enhances the heat transfer characteristics of the fin, and allows for the use of thinner materials to lower cost without diminishing airside thermal-hydraulic performance.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
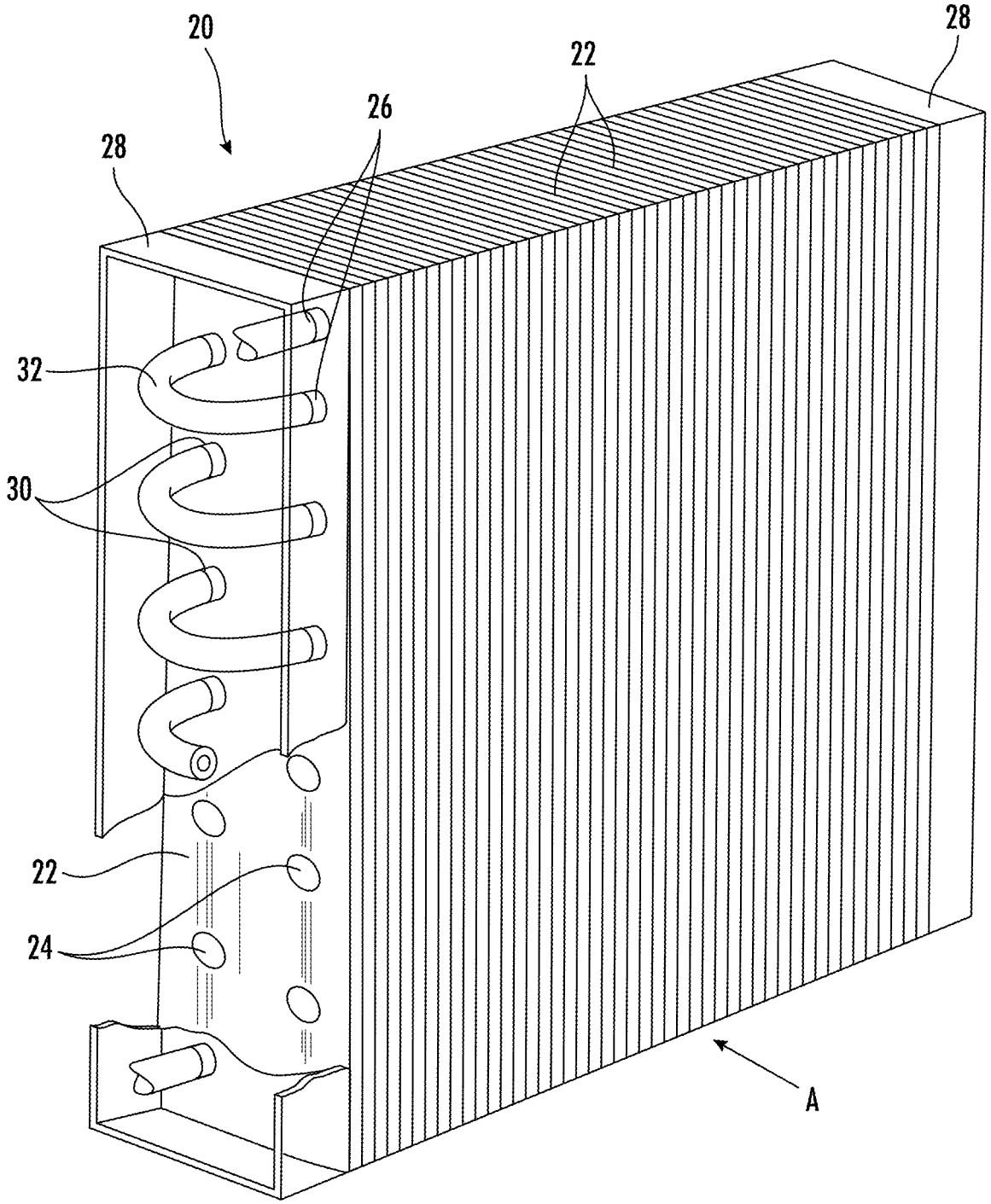
FIG. 1 is a perspective view of an exemplary round tube plate fin heat exchanger coil according to an embodiment.

Referring to FIG. 1, an exemplary plate finned tube heat exchanger coil 20 is illustrated. As shown, the heat exchanger coil 20 includes at least one plate fin 22, such as a plurality of plate fins for example. Each plate fin 22 has one or more holes 24 formed therein for receiving one or more tubes 26 of the heat exchanger coil 20. The plurality of plate fins 22 are maintained together by oppositely positioned tube sheets 28 having holes 30 therethrough in axially alignment with tube holes 24. The plurality of tubes 26 are laced through the holes 24, 30 formed in the plate fins 22 and the tube sheets 28 and have their open ends joined together in fluid communication by u-shaped return bends 32, which are secured to the tubes 26 by soldering, brazing or the like. In an embodiment, there is no interference between the tubes 26 and the tube sheets 28; rather, the tubes 26 are only arranged in contact with the plate fins 22.

In operation, a first fluid to be cooled or heated flows through the tubes 26 and a second cooling or heating fluid is then passed between fin sheets 22 and over an exterior surface of the tubes 26 in a direction indicated by arrow A. Heat energy is transferred from or to the first fluid through the tubes 26 and the plate fins 22 to or from the other fluid. The fluids may be different types, for example, the fluid flowing through tubes 26 can be a refrigerant and the fluid flowing between plate fins 22 and over the tubes 26 can be air. However, embodiments where the fluids are the same type of fluid are also contemplated herein.

In the illustrated, non-limiting embodiment of FIG. 1, the plate fin tube heat exchanger coil 20 is a staggered two-row coil since each plate fin 22 has two rows of staggered holes therein for receiving tubes. However, it should be understood that a plate fin tube heat exchanger coil 20 having any number of rows of tubes, such as only a single row of tubes, or more than two rows of tubes, and also a plate fin tube heat exchanger coil 20 where the holes 24 for receiving the tubes are staggered or aligned with the holes 24 of an adjacent row are within the scope of the disclosure.

Figure 2:
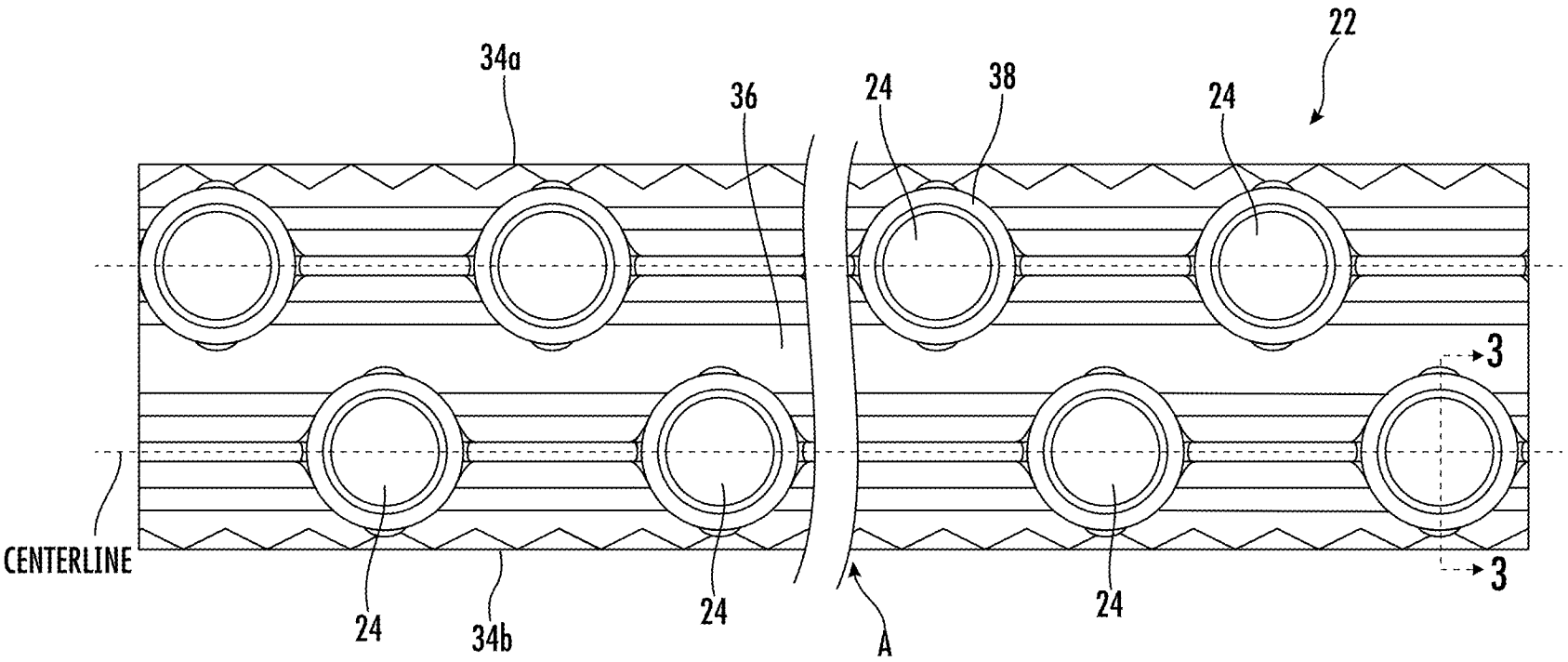
FIG. 2 is a plan view of a plate fin of the round tube plate fin heat exchanger coil of FIG. 1 according to an embodiment.

With reference to FIG. 2, an exemplary plate fin 22 is illustrated in more detail. As shown, the plurality of holes 24 are arranged in one or more rows, with all the holes in a given row having a common centerline that is oriented parallel to fin edges 34*a*, 34*b*. Between each row of tube holes 24 is an inter-row area 36. In an embodiment, a fin collar 38 surrounds each tube hole 24. The fin collar 38 is configured to extend outwardly from a surface of plate fin 22 in a first direction. By the length to which they extend from the surface of the fin 22, the plurality, of fin collars 38 serve to determine the spacing between the plurality of plate fins 22 in a given heat exchanger coil 20. The plurality of fin collars 38 may also function to ensure that there is a sufficient area of contact and a close mechanical fit, and therefore good thermal conduction, between the plate fins 22 and the tubes 26.

Figure 3:
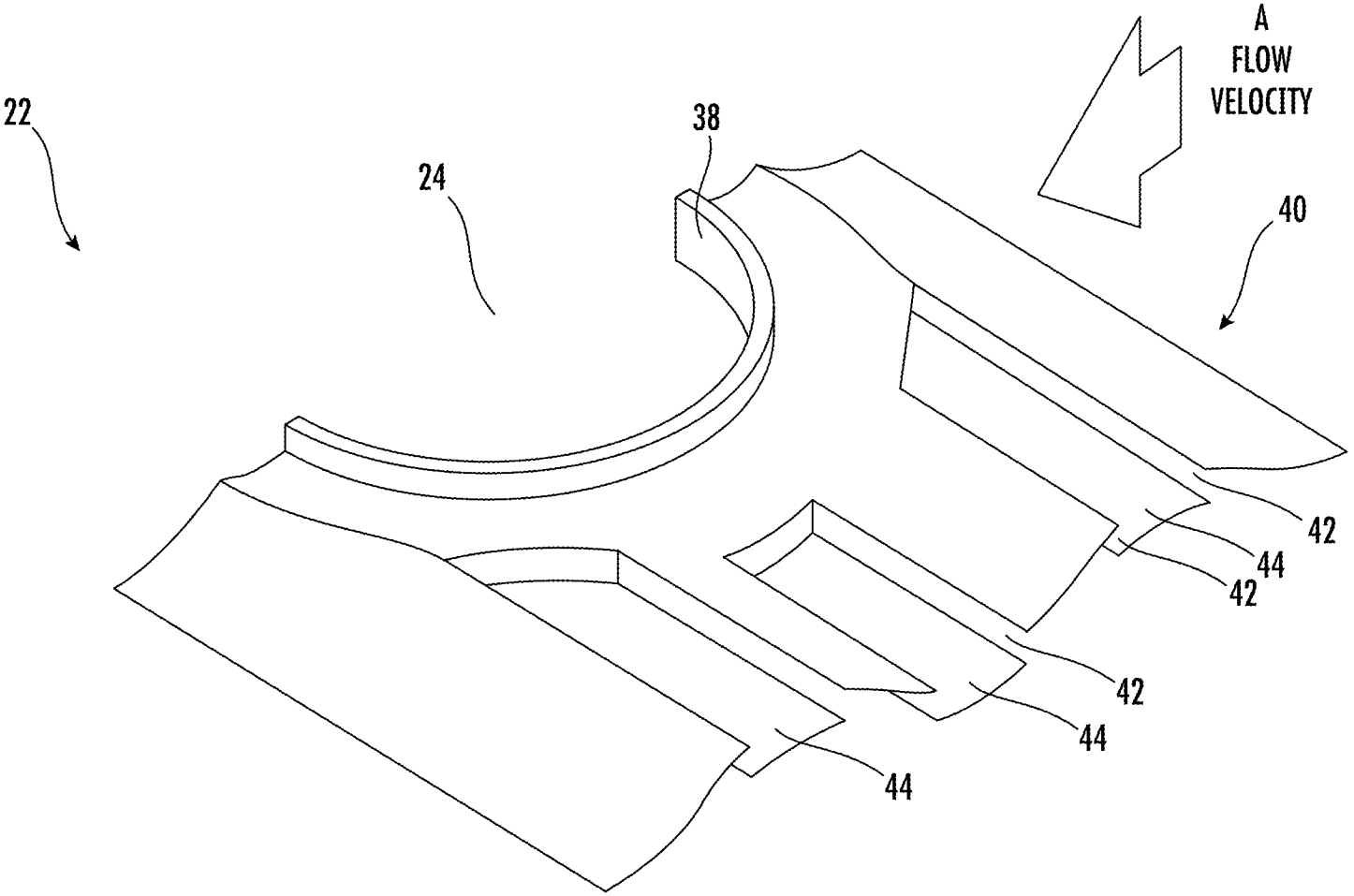
FIG. 3 is a perspective sectional view of an exemplary contoured region of the plate fin according to an embodiment.

FIG. 3 is a perspective view of a cross-section of the plate fin 22 of FIG. 2 taken in a plane (line 3-3) oriented generally transverse to the plate fin 22. As shown, the plate fin 22 includes a contoured region 40 disposed between adjacent holes 24 in the same row. The contoured region 40 may include a sinusoidal corrugation or sine-like waveform that runs parallel to the direction of the air flow A and perpendicular to the edges 34*a*, 34*b* of the plate fin 22, As used herein the term "sinusoidal" is intended to cover waveforms or patterns that may be either true sine curves or approximations of a sine curve. Further, it should be understood that term "sinusoidal corrugation" may additionally include waveforms that represent a sine wave with a phase shift, for example resulting in a cosine-like waveform. Design requirements and practical considerations inherent in preparing tooling and in manufacturing the fins 22 mean that the waveforms may not necessarily be mathematically precise sine curves.

In the illustrated, non-limiting embodiment of FIG. 3, the contoured region 40 includes a sinusoidal corrugation extending two wave counts in the flow direction, A. Accordingly, the sinusoidal corrugation has two peaks and two valleys associated therewith. However, embodiments having a contoured region 40 including a sinusoidal corrugation extending less than two wave counts, such as a single wave count or 1.5 wave count, or alternatively, more than two wave counts are also contemplated herein. For example, in the non-limiting embodiment of FIGS. 4 and 5, the sinusoidal corrugation extends about 2.5 wave counts. Each wave of the wave count has a respective wavelength L. Further, although the wavelength L of each wave within the wave count is illustrated as being generally equal, embodiments where the wavelengths may vary in the direction of the airflow are also contemplated herein.

Figure 4:
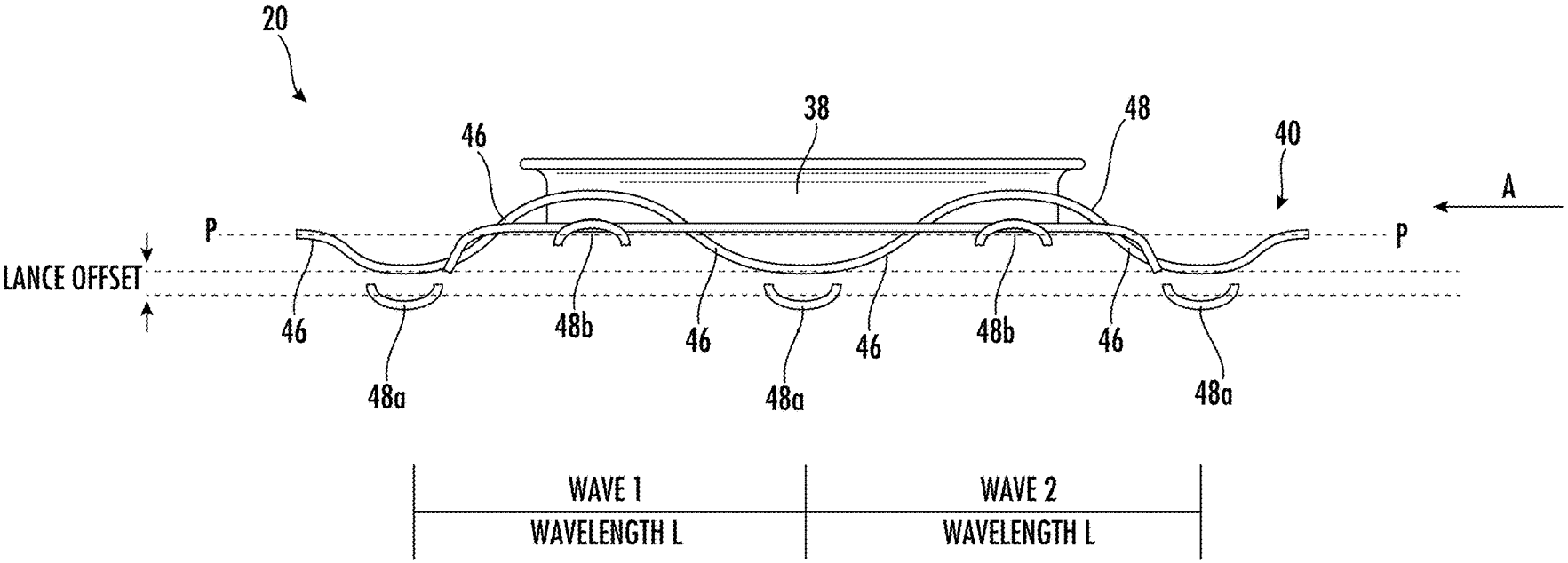
FIG. 4 is a cross-sectional view of the contoured region of FIG. 3 according to an embodiment.
Figure 5:
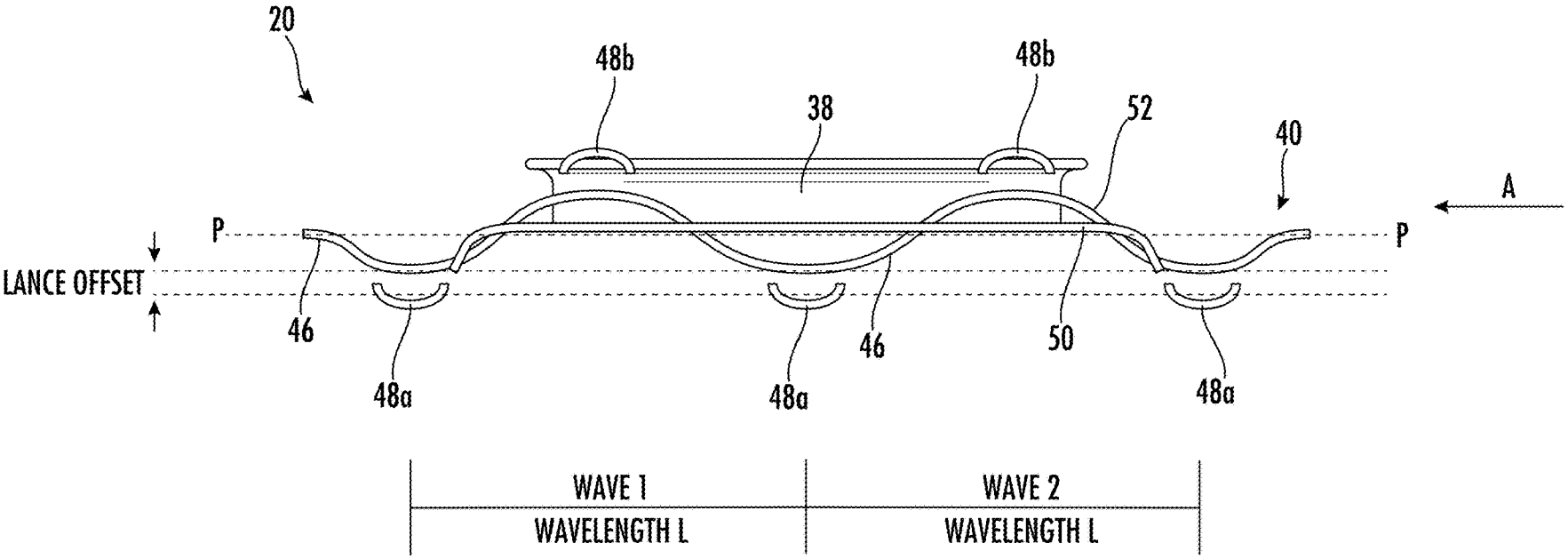
FIG. 5 is a cross-sectional view of another contoured region of a plate fin according to an embodiment.

In an embodiment, the sinusoidal corrugations including at least one peak and at least one valley located at the contoured region 40 of the plate fin 22 do not have a continuous surface. Rather, at least one elongate lance element 44 is created and defined by longitudinal slits 42. In the illustrated, non-limiting embodiment of FIG. 3, the six longitudinal slits 42 in the contoured region 40 of the plate fin 22 form a total of seven lance elements 44. In another embodiment, as illustrated in FIGS. 4 and 5, the contoured region 40 includes eleven lance elements 44. Accordingly, it should be understood that a contoured region 40 having any suitable number of lance elements, such as five lance elements, six lance elements, eight lance elements, nine lance elements, ten lance elements, twelve lance elements, or thirteen lance elements for example, are within the scope of the disclosure.

Although the slits 42 are illustrated as extending perpendicular to the direction of the air flow A, or parallel to the edges 34*a*, 34*b* of the plate fin 22, embodiments where one or more of the slits 42 is arranged at an angle to an edges 34*a*, 34*b* of the plate fin 22 are also within the scope of the disclosure. In an embodiment, the lance elements 44 are only located at a portion of the sinusoidal corrugation axially aligned with a portion of the tube hole 24. Accordingly, a trough formed between adjacent tube rows, such as within inter-row area 36 for example, does not have any lance elements 44 formed therein.

As shown in FIGS. 3-5, a first portion 46 of the lance elements 44 are fixed in place along the curvature of the sinusoidal corrugation. These lance elements also referred to herein as fixed lance "elements." The second portion 48 of the lance elements 44 are moved, for example translated, after formation thereof, such as relative to the mean line of the sinusoidal corrugation, illustrated as the central plane P (see FIGS. 4 and 5). The lance elements 48 that have an adjusted position may also be referred to herein as "adjusted lance elements." In the embodiment shown in FIG. 3, the sinusoidal corrugation includes four fixed lance elements 46 and three adjusted lance elements 48. In the non-limiting embodiment of FIGS. 4 and 5, the sinusoidal corrugation includes six fixed lance elements 46 and five adjustable lance dements 48.

In an embodiment, the plurality of lance elements 44 maintain the curvature of the sinusoidal corrugation. Said another way, each of the plurality of elongate lance elements 44 has a cross-sectional shape that is a segment of the sinusoidal corrugation. The adjustable elongate lance elements 48 may be cut or lanced such that the slits 42 defining the adjustable lance elements 48 are disposed on opposite sides of the peaks and troughs of the sinusoidal corrugation. Accordingly, an adjustable lance element 48 arranged at a peak of the sinusoidal corrugation has a generally, concave curvature and an adjustable lance element 48 arranged at a valley of the sinusoidal configuration has a generally convex curvature. In such embodiments, the wave count over which the sinusoidal corrugation extends will at least partially determine the total number of lance elements 44 included. Although the adjustable lance elements 48 are illustrated as being positioned at the peaks and troughs respectively, of the sinusoidal corrugations, it should be understood that an adjustable lance element 48 may be formed at any position along the sinusoidal corrugations.

With reference now to FIGS. 4 and 5, an end view of a contoured region 40 of the plate fin 22 is illustrated. As shown, the horizontal central plane P extends generally through the sinusoidal corrugation at a midpoint of the amplitude or height of the waveform. Accordingly, the distance between the plane P and a peak of the sinusoidal corrugation is equal to a distance between the plane P and a valley of the sinusoidal corrugation. In an embodiment, the at least one adjusted lance element 48 may be offset from the sinusoidal corrugation by a distance referred to as lance offset as exemplified in FIGS. 4 and 5.

As shown in FIG. 4, in an embodiment, at least one of the adjusted lance elements 44 is moved in a downward direction, beyond a lower surface 46 of the plate fin 22. In an embodiment, this downward direction is a second direction, opposite the first direction in which the fin collar 38 extends from the plate fin 22. As shown, each of the adjusted lance elements 48*a* originated from a valley of the sinusoidal corrugation is moved downwardly away from plane P, such that an upper surface of the lance element 48*a* is positioned vertically beneath a lower surface 50 of the plate fin 22. As a result of this movement, the distance between the lance element 48*a* and the plane P increases. Each of the lance elements 48*b* originated from a peak of the sinusoidal corrugation may be similarly moved in the same second, downward direction such that an upper surface of the lance element 48*b* is positioned vertically beneath the lower surface 50 of the plate fin 22. However, the downward movement moves the lance elements 48*b* towards the plane P such that the distance between the lance elements 48*b* and the plane P decreases. Accordingly, the distance between the plane P and the lance elements 44 a is different than the distance between the lance elements 44*b* and the plane P. In an embodiment, the distance by which the lance elements 44*a* and the lance elements 44*b* are offset from the sinusoidal corrugation, in a direction perpendicular to the direction of flow A, such as relative to the plane P for example, also referred to herein as the lance offset, may be uniform.

In another embodiment, best shown in FIG. 5, the at least one lance element 48*a* arranged at a valley of the sinusoidal corrugation is moved in an opposite direction as at least one lance element 48*b* arranged at a peak of the sinusoidal corrugation. As shown, each of the lance elements 44*a* arranged at a valley of the sinusoidal corrugation is moved in the second direction, downwardly away from plane P. As a result, an upper surface of the lance element 48*a* is positioned vertically beneath the lower surface 50 of the plate fin 22. Because of this movement, the distance between the lance element 48*a* and the plane P increases. Similarly, each of the lance elements 48*b* formed at a peak of the sinusoidal corrugation is moved in the first, upward direction in which the fin collar 38 extends from the plate fin 22. With this movement away from the plane P, the lower surface of the lance element 48*b* may be positioned vertically above the upper surface 52 of the plate fin 22. In an embodiment, the total distance that each lance element 48*a*, 48*b* is moved in a direction perpendicular to the direction of flow A, such as relative to the plane P for example, may be equal, or alternatively, may vary.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heat exchanger comprising a plurality of plate fins, at least one plate fin comprising:

a plurality of holes arranged in one or more rows; and a contoured region formed adjacent one of the plurality of holes having a sinusoidal corrugation, the contoured region comprising a plurality of elongate lance elements having an arcuate shape, the plurality of elongate lance elements including a first, fixed portion of lance elements and a second, adjusted portion of lance elements, said first, fixed portion of lance elements being arranged at the sinusoidal corrugation and the second, adjusted portion of lance elements being lowered relative to a central plane arranged at a midpoint of an amplitude of the sinusoidal corrugation, the first fixed portion of lance elements alternating with the second, adjusted portion of lance elements over the sinusoidal corrugation;

wherein the sinusoidal corrugation includes at least one peak and at least one valley, at least one elongate lance element is formed at the at least one valley and at least one elongate lance element is formed at the at least one peak, the at least one elongate lance formed at the at least one valley is moved downwardly away from the central plane, and the at least one elongate lance formed at the at least one peak is moved downwardly toward the central plane.

2. The heat exchanger of claim 1, wherein the contoured region is arranged between adjacent holes within one of the one or more rows.

3. The heat exchanger of claim 1, wherein the sinusoidal corrugation extends over at least one sinusoidal corrugation wavelength.

4. The heat exchanger of claim 3, wherein the at least one sinusoidal corrugation wavelength comprises two sinusoidal corrugation wavelengths, and the two sinusoidal corrugation wavelengths are constant.

5. The heat exchanger of claim 3, wherein the at least one sinusoidal corrugation wavelength comprises two sinusoidal corrugation wavelengths, and the two sinusoidal corrugation wavelengths vary.

6. The heat exchanger of claim 1, wherein each of the plurality of elongate lance elements has a cross-section that is a segment of the sinusoidal corrugation.

7. The heat exchanger of claim 1, wherein the at least one elongate lance element of the plurality of elongate lance elements being formed at the at least one valley has a generally convex curvature.

8. The heat exchanger of claim 1, wherein the at least one elongate lance element of the plurality of elongate lance elements is formed at the at least one peak has a generally concave curvature.

* * * * *